US005394228A

United States Patent [19]

Godlove

[11] Patent Number: 5,394,228

[45] Date of Patent: Feb. 28, 1995

[54] CLEANING BLADE SYSTEM FOR PHOTOCOPY MACHINE

[75] Inventor: Ronald E. Godlove, Bergen, N.Y.

[73] Assignee: Xerox Corporation, Stamford, Conn.

[21] Appl. No.: 92,145

[22] Filed: Jul. 15, 1993

[51] Int. Cl.[6] ..... G03G 21/00

[52] U.S. Cl. ..... 355/299; 15/236.05; 15/256.52

[58] Field of Search ..... 355/299, 300, 296; 15/236.05, 236.10, 256.50, 256.51, 256.52

[56] References Cited

U.S. PATENT DOCUMENTS

| | | | |
|---|---|---|---|
| 3,706,108 | 12/1972 | Taylor | 15/1.51 |
| 4,862,221 | 8/1989 | Tabuchi et al. | 355/300 |
| 5,081,505 | 1/1992 | Ziegelmuller et al. | 355/299 |
| 5,208,639 | 5/1993 | Thayer et al. | 355/299 |

FOREIGN PATENT DOCUMENTS

| | | | |
|---|---|---|---|
| 0169780 | 10/1982 | Japan | 355/299 |
| 0011883 | 1/1987 | Japan . | |
| 0032484 | 2/1987 | Japan . | |
| 0156492 | 5/1992 | Japan . | |
| 1014565 | 4/1983 | U.S.S.R. | 15/236.05 |

OTHER PUBLICATIONS

Thayer, Xerox Disclosure Journal, vol. 4, No. 5, Sep.-/Oct. 1979.

*Primary Examiner*—Robert B. Beatty

*Attorney, Agent, or Firm*—Fay, Sharpe, Beall, Fagan, Minnich & McKee

[57] ABSTRACT

A compact multi-blade cleaning system for a photoreceptor device, such as a belt or a drum used in the electrostatographic printing process includes a block of thermoplastic material. The block has a plurality of parallel cuts extending partially therethrough so as to form a plurality of cleaning blades. Each of these has a cleaning edge, adapted for contact with a surface of the photoreceptor device and an opposed securing edge. An uncut portion of the block forms a connecting member for connecting the plurality of cleaning blades at their securing edges so that they move in unison. A mechanism is provided for advancing the plurality of cleaning blades, one by one, into contact with the photoreceptor device.

20 Claims, 2 Drawing Sheets

CLEANING BLADE SYSTEM FOR PHOTOCOPY MACHINE

BACKGROUND OF THE INVENTION

The present application relates generally to office machines. More particularly, it relates to an improved cleaning device for an electrostatographic printing machine.

The invention is particularly suited for use in cleaning a photoreceptor device such as a belt or drum of an electrostatographic printing machine. However, it should be appreciated that the apparatus could also be used in many other types of office machines.

In electrostatographic printing apparatus commonly used today, a photoconductive insulating member is typically charged to a uniform potential and thereafter exposed to a light image of an original document to be reproduced. The exposure discharges the photoconductive insulating surface in the exposed or background areas and creates an electrostatic latent image on the member which corresponds to the image contained within the original document. Alternatively, a light beam may be modulated and used to selectively discharge portions of the charged photoconductive surface to record the desired information thereon. Typically, such a system employs a laser beam. Subsequently, the electrostatic latent image on the photoconductive insulating surface is made visible by developing the image with developer powder referred to in the art as toner. Most development systems employ developer which comprises both charged carrier particles and charged toner particles which triboelectrically adhere to the carrier particles. During development, the toner particles are attracted from the carrier particles by the charged pattern of the image areas of the photoconductive insulating area to form a powder image on the photoconductive area. This toner image may be subsequently transferred to a support surface, such as copy paper, to which it may be permanently affixed by heating or by the application of pressure.

In commercial applications of such products, it is necessary to clean the photoreceptor belt or drum after the print has been made in order to prepare the photoreceptor device for the next print cycle. Cleaning of the photoreceptor belt or drum includes two steps. First, the residual image needs to be removed from the photoreceptor device. The residual image is the toner image which remains on the photoreceptor device after the transfer process. Second, any remaining charge on the photoreceptor device must be removed. This requirement insures that the photoreceptor device starts the next print cycle electrically neutral. Toner is usually removed from the photoreceptor belt or drum by scraping its surface with a blade.

Conventional blades are flexible, usually made of rubber or synthetic material and contact the photoreceptor surface at an angle so that toner is physically scraped off the photoreceptor. One difficulty with such conventional cleaning blades is that the blade needs to be replaced after a period of time. This in turn necessitates removing the machine from operation while the cleaning blade is replaced. In addition, with conventional cleaning blades, in order to insure that the blade lasts as long as possible, a relatively expensive material needs to be utilized for the cleaning blade.

Accordingly, it has been considered desirable to develop a new and improved cleaning blade assembly which would overcome the foregoing difficulties and others while providing better and more advantageous overall results.

BRIEF SUMMARY OF THE INVENTION

The present invention relates to a cleaning system for a photoreceptor device such as a drum or a belt.

More specifically, the cleaning system comprises a plurality of cleaning blades each having a cleaning edge for contact with the surface of a photoreceptor device and connecting means for connecting the plurality of cleaning blades so that they move in unison. A mechanism is provided for advancing the plurality of cleaning blades, one by one, into contact with the photoreceptor device.

If desired, the connecting means can comprise an endless loop and the mechanism for advancing the cleaning blades can comprise a pair of rotatable shafts which selectively propel the endless loop. Preferably, the shafts have a square periphery and are spaced from each other so as to stretch the endless loop between them. Preferably, each blade is approximately as thick as one of the shafts.

In accordance with another aspect of the invention, a compact multi-blade cleaning system is provided for a photoreceptor device such as a belt or a drum.

More particularly in accordance with this aspect of the invention, the cleaning system includes a block of a thermoplastic material which is partially cut through so as to form a plurality of cleaning blades, each having a cleaning edge for contact with the surface of the photoreceptor device and an opposed securing edge. A connecting means, formed by an uncut portion of the block, is provided for connecting the plurality of cleaning blades at their securing edges so that they move in unison. A mechanism is provided for advancing the plurality of cleaning blades, one by one, into contact with the photoreceptor device.

One advantage of the present invention is the provision of a new and improved cleaning system for use in an office machine.

Another advantage of the present invention is the provision of a multi-blade cleaning system for a photoreceptor device such as a belt or drum used in electrostatographic printing.

Still another advantage of the present invention is the provision of compact cleaning device comprising a plurality of cleaning blades which can be advanced, one by one, into contact with a photoreceptor surface such as a belt or drum in order to scrape toner particles off the photoreceptor device.

Yet another advantage of the present invention is the provision of a compact cleaning system comprising a plurality of blades that are formed from a rectangular block of a plastic material which has a series of parallel cuts partially through it and is joined at its ends by a seam in order to form an endless belt.

A further advantage of the present invention is the provision of a multi-blade cleaning system which lasts the expected lifetime of the electrostatographic machine in which it is installed so as to prevent any need for blade replacement during the expected lifetime of the machine.

A still further advantage of the present invention is the provision of a multi-blade cleaning system for a photoreceptor device in which a large number of blades can be stored in a small volume with each blade being brought into contact with the photoreceptor device as needed.

Still other benefits and advantages of the present invention will become apparent to those skilled in the art upon a reading and understanding of the following detailed specification.

BRIEF DESCRIPTION OF THE DRAWINGS

The invention will take form in certain parts and arrangements of parts, a preferred embodiment of which will be described in detail in this specification and illustrated in the accompanying drawings which form a part hereof and wherein.

DETAILED DESCRIPTION OF THE PREFERRED EMBODIMENT

Figure 3:
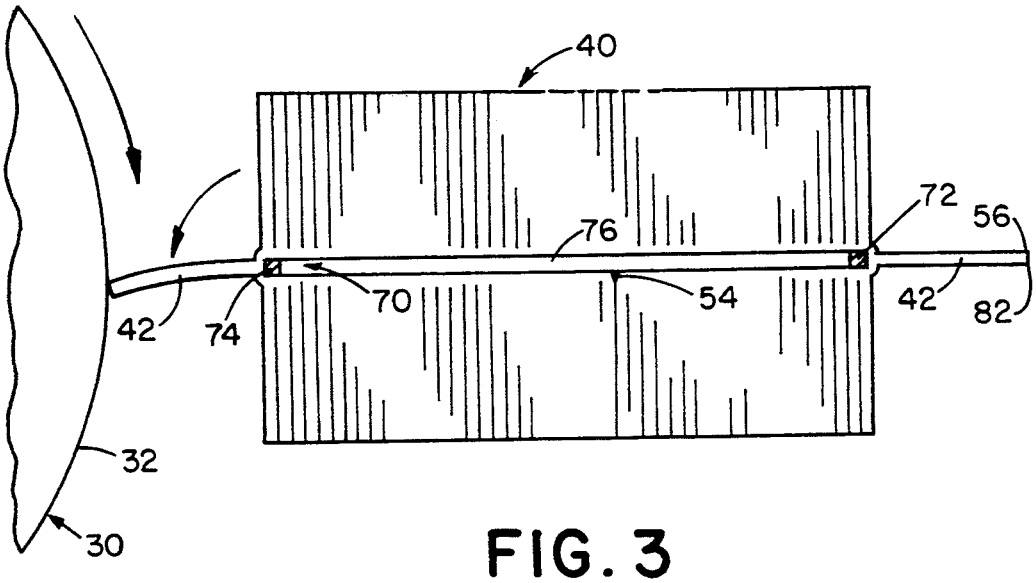
FIG. 3 is a side elevational view of a compact multi-blade cleaning system in contact with a photoreceptor drum according to the present invention.

Referring now to the drawings, wherein the showings are for purposes of illustrating a preferred embodiment of this invention only and not for purposes of limiting same, FIG. 3 shows the multi-blade cleaning system of the present invention.

Figure 1:
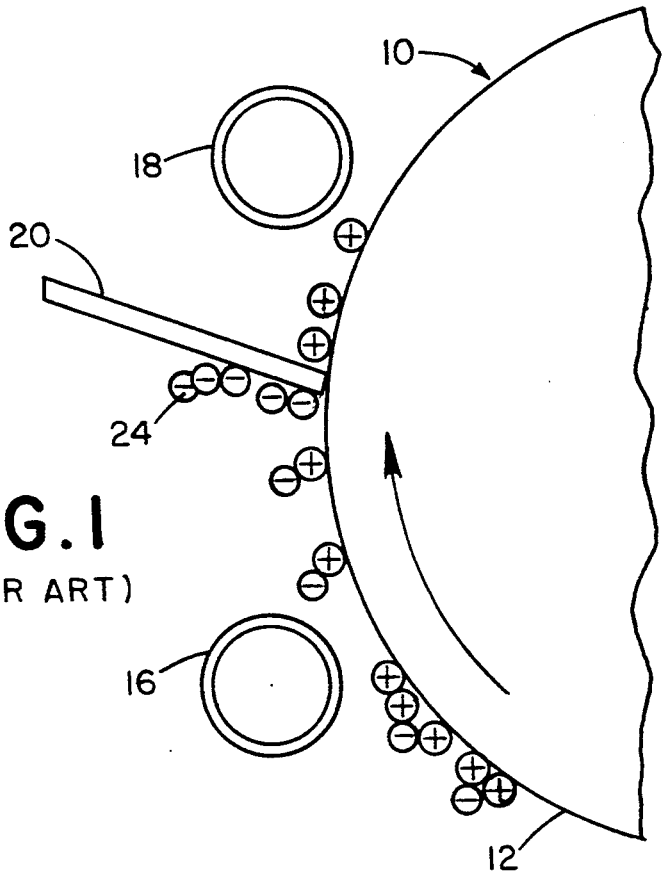
FIG. 1 (PRIOR ART)
FIG. 1 is a side elevational view of a cleaning blade in contact with a photoreceptor drum according to the prior art.

When a xerographic print is complete, all that remains is to prepare the photoreceptor device for the next print cycle. This is the cleaning step of the xerographic process. With reference now to FIG. 1, the prior art cleaning included two tasks. First, the residual image was removed from the photoreceptor device 10 which is illustrated in the form of a drum and, second, any remaining charge on the photoreceptor was removed. In this description it will be presumed that the photoreceptor device was positively charged. After the toner is transferred to the sheet material on which the image is fixed, the residual toner must be physically removed from the photoreceptor and deposited in a sump area. This step is usually accomplished mechanically by cleaning an exterior surface 12 of the device 10. Occasionally, toner removal is aided electrostatically by reducing the charge on the photoreceptor through the use of a preclean lamp 16. A discharge lamp 18 is often also used. Such lamps as the preclean lamp and discharge lamp can be either light sources, such as incandescent lamps, fluorescent lamps, neon lamps, light emitting diodes or electroluminescent strips or AC corotrons, as is known in the art.

Figure 2:
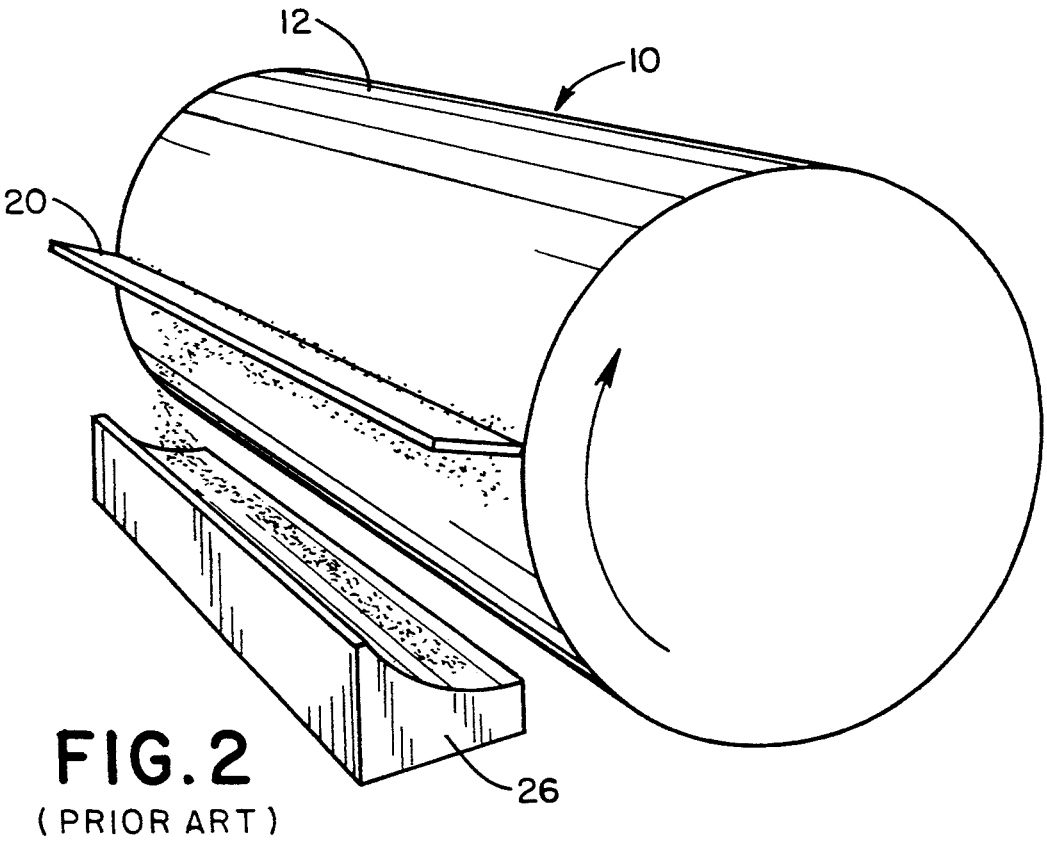
FIG. 2 (PRIOR ART)
FIG. 2 is a perspective view of a cleaning blade in contact with a photoreceptor drum according to the prior art.

The toner is generally removed from the photoreceptor 10 by scraping its surface 12 with a blade 20. The blade is flexible, usually made of a rubber or synthetic material, and extends along the entire width of the photoreceptor drum which is illustrated in FIG. 2. The toner which is physically removed by the blade is illustrated by the numeral 24. Removed toner is deposited in a sump area 26 as illustrated in FIG. 2. The preclean lamp and discharge lamp of FIG. 1 are not illustrated in FIG. 2 for the sake of simplicity.

The blade 20 contacts the photoreceptor surface at an angle so that the toner 24 is physically scraped off. In order to insure that the blade 20 does not damage the photoreceptor, the blade is very carefully positioned against the photoreceptor. In addition, toner particles generally have some lubricant mixed with them in order to minimize damage from the blade scraping on the outer surface 12 of the photoreceptor 10.

In conventional cleaning processes, a relatively expensive material must be utilized for the cleaning blade since when the blade fails, the electrostatographic machine has to be removed from service so that a new cleaning blade can be mounted in its place. While blades have an average life expectancy of approximately 750,000 copies, the electrostatographic printing apparatus has a much longer life. Accordingly, cleaning blades routinely need to be replaced on the machines. In addition, the blades fail randomly. Accordingly, one never knows when a particular cleaning blade will fail and will need to be replaced. Detection of blade failure is accomplished by a conventional photoelectric detector downstream from the cleaning blade which detects undue amounts of toner on the photoreceptor device.

Figure 4:
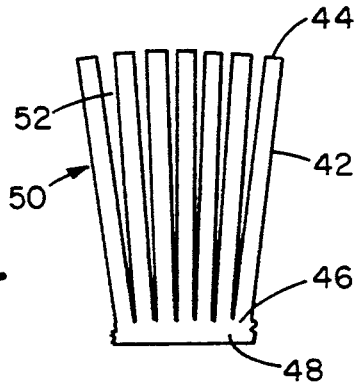
FIG. 4 is an enlarged side elevational view of a portion of a block of material used in the multi-blade cleaning system of FIG. 3.

With reference now to FIG. 3, the present invention comprises a cleaning system for a photoreceptor device 30 having an outer surface 32. A blade assembly is illustrated overall by the numeral 40. It comprises a plurality of cleaning blades 42. With reference now to FIG. 4, each of these blades includes a free end 44 and a securing end 46. The plurality of securing ends of the blades 42 are held together by a securing means 48. Preferably, the cleaning system is formed from a block 50 of material which has a series of parallel slits cut nearly through the thickness of the material thereby forming the blades 42 and at the same time forming the securing means 48 comprising the uncut portion of the material. The cuts are made parallel to each other at ninety degrees to the surface of the material and at a distance between them equal to the thickness of the resulting blades 42. As shown in FIG. 4, when adjacent blades 42 are pulled apart, a gap 52 is formed between them.

Preferably, the block of now cut material has its free ends secured to each other along a seam 54 as shown in FIG. 3. Such a seam can be formed by suitable adhesives or friction welding or the like of the two adjoining surfaces at the ends of the block of material 50. By securing the two ends of the block 50 to each other, the block is now oriented into a loop or endless belt type configuration as is evident from FIG. 3.

It is considered advantageous to manufacture the blade assembly from a flat rectangular piece of plastic material. Since in its entire cycle of use the material only is expected to rotate around the two shafts 72 and 74 once, repeated wear on the seam 54 by rotation around the shafts 72 and 74 should not be a problem.

Figure 5:
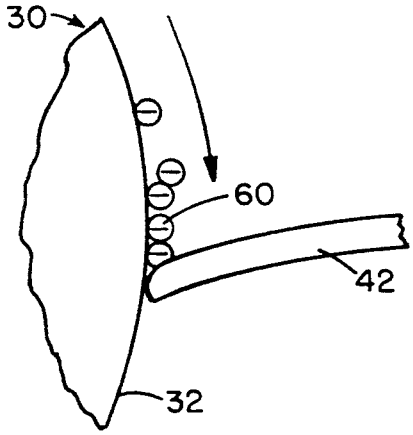
FIG. 5 is a side elevational view in an enlarged scale of a cleaning blade of FIG. 3 in a first orientation; and, FIG. 6 is a side elevational view of the cleaning blade of FIG. 5 in a second orientation.
Figure 6:
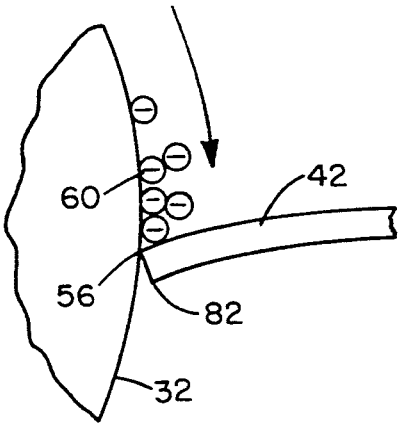

Each of the blades 42 has at its free end 44 a scraping edge 56. As shown in FIGS. 5 and 6, the scraping edge 56 scrapes a toner material 60 off the outer surface 32 of the photoreceptor device 30. It should be noted that the photoreceptor device 30 of FIGS. 3, 5 and 6 rotates in the direction opposite to the direction illustrated for the device of FIGS. 1 and 2. It should also be recognized that while a drum type of photoreceptor device 30 is illustrated in FIGS. 3, 5 and 6, a photoreceptor belt, as is well known to those of average skill in the art, could be similarly cleaned by the cleaning system 40 of the present invention.

A mechanism 70 is disclosed in FIG. 3 for advancing the plurality of blades 42, one at a time, into contact with surface 32 of the photoreceptor device 30. The mechanism comprises first and second square shafts 72 and 74. A pulling force is exerted on the blade assembly by tension maintained by the spacing between the shafts 72 and 74 so as to create a slot 76 of substantially constant width between the two spaced shafts. More specifically, the inner circumference of the blade assembly is less than twice the distance between the two shafts 72 and 74 plus twice the three-quarter perimeter of shaft 72 and twice the three-quarter perimeter of shaft 74.

The cross section of each shaft 72 and 74 is square, as mentioned. This cross-section is useful in that the two shafts rotate 90 degrees when advancing the next blade 42 into a cleaning position. It is noted in this regard that the width of each blade 42 is substantially identical to the width of the two shafts 72 and 74. The shafts 72 and 74 are rotated by a conventional motor means which is not illustrated in the Figures for the sake of simplicity. It should be noted that the shafts 72 and 74 need to be at least as long as the length of the blades in order to engage the blades along their entire length for good frictional contact when the endless belt formed from the block 50 is rotated so as to bring individual blades 42 into contact with the photoreceptor device outer surface 32.

With regard again to FIG. 3, it may be necessary to provide an air cleaner to remove collected toner from between the used blades. Otherwise, toner entrapped between the blades would prevent the cut edges from completely closing and would result in a bow among the used blades. Such air cleaners are known to the art and are not illustrated in the Figures for the sake of simplicity.

As many as one hundred blades can be provided in the blade assembly 40. If each of these blades has an average lifetime of 750,000 copies, then with 100 blades, it is anticipated that 75,000,000 xerographic prints can be provided by the machine. That is, up to 75,000,000 cycles could be performed by the photoreceptor device before a new cleaning system would be needed. Since the average lifetime of the electrostatographic printing device is usually less than this number of cycles, it is anticipated that the cleaning system of the present invention will suffice for the lifetime of the machine in question. In general, as many blades 42 would be provided as may be necessary to last the expected lifetime of the electrostatographic machine.

The blades 42 can have a thickness of 70–100 thousandths of an inch and a length of approximately one half to three quarters of an inch. The width of the blade, as mentioned, would be approximately the same as the width of the photoreceptor device. This can be on the order of approximately 9 to 12 inches. The loading on the blade is by simple mechanical interference. The loading factor per linear centimeter of the blade should be in the neighborhood of 35–45 grams at a working angle of 10–20 degrees.

The blades 42 are cut to within 10–20 thousandths through the block of material. The loading on the blades is not sufficient to propagate this cut all the way through the securing means 48 or belt of material.

With reference now to FIGS. 5 and 6, the blade 42, at the edge 56, adheres to the surface 32 of the photoreceptor device 30 when no toner particles are present. Thus the blade 42 is somewhat bent as the blade edge 56 tucks under in the direction of the motion of the device 30. However, when a particle of toner 60 works its way under the blade, it unadheres the blade. At this point, as shown in FIG. 6, the blade straightens out and the toner gets kicked backwards. A pile of toner is thus formed. This toner spills over the blade to a waste toner sump, such as the sump illustrated in FIG. 2. It may also be desirable to provide an auger (not illustrated) to transport the toner away from the blade as is known to the art. Also, sometimes a known thumper (not illustrated) is used to clean the toner off the blade. Mostly, the toner is not reused although sometimes it may be.

Using a cleaning system 40 having a plurality of blades 42 is advantageous in that it allows the choice of an inferior material for the blades from the aspect of life expectancy and durability. If any single blade fails, that blade is removed and easily replaced with the next blade in the blade assembly 40 by a mere ninety degree rotation of the shafts 72 and 74. In the preferred embodiment, it is anticipated that the blade material would be a urethane elastomer. It should be recognized, however, that other materials can also be utilized.

As previously discussed, the shafts 72 and 74 will rotate ninety degrees when a new blade 42 is to brought into contact with the photoreceptor device surface 32. Such rotation can occur upon a failure of the blade 42 as previously discussed. Alternatively, such rotation can occur after a set number of copies or manually when so desired by the operator. Means can also be provided on the electrostatographic machine to determine when there are no more unused blades left. Since the number of blades on the assembly can be ascertained upon installation, the machine control system can count how many blades are used through the lifetime of the machine and indicate to the operator when all of the blades 42 have been used.

The present cleaning system is also advantageous in that a compact storage means is provided for the plurality of blades 42. This arrangement is much more compact than would be a multi-blade holder or a roll.

While in the preferred embodiment, the plurality of blades 42 were cut from a single block 50 of material so that the blades were secured to each other by an uncut portion 48 of the block, it should be recognized that other ways of providing such a plurality of connected blades can also be conceived of. For example, a plurality of separate blades could each have one end adhered or affixed to an endless belt made of a different material or the same material. This would provide the same type of arrangement as is evident from FIG. 3 of the drawings but with a separate belt providing the connecting means for securing the plurality of blades together.

It is noted that the free end 44 of each blade 42 is provided not only with a first cleaning edge 56 but also with a second opposed edge 82. This opposed edge can also be utilized for cleaning if so desired. Once all the blades have been used, the blade assembly 40 conceivably could be removed, reversed inboard for outboard and the unused cleaning edges 82 not previously having engaged the photoreceptor device surface 32 could then be used. This would enable one to double the life of the blade assembly 40, if needed.

The invention has been described with reference to a preferred embodiment. Obviously, alterations and modifications will occur to others upon a reading and understanding of this specification. It is intended to include all such modifications and alterations insofar as they come within the scope of the appended claims or the equivalents thereof.

Having thus described the present invention, it is now claimed:

1. A cleaning system for a photoreceptor device, comprising:

a plurality of cleaning blades, each having a cleaning edge for contact with a surface of a photoreceptor device;

a connecting means, which comprises an endless loop, for connecting said plurality of cleaning blades so that they move in unison; and, a mechanism for advancing said plurality of cleaning blades into contact with said photoreceptor device, wherein only a single blade contacts said photoreceptor device at any given time, wherein said mechanism comprises a pair of rotatable shafts which selectively propel said endless loop.

2. The cleaning system of claim 1 wherein said plurality of cleaning blades are cut from a block of material so as to each have a securing edge opposite said cleaning edge and said connecting means comprises an uncut portion of said block of material provided at said securing edge of each blade.

3. The cleaning system of claim 1 wherein said shafts each have a substantially square periphery.

4. The cleaning system of claim 3 wherein said shafts are spaced from each other so as to stretch said endless loop between them.

5. The cleaning system of claim 4 wherein each of said blades is approximately as thick as one of said shafts.

6. A compact multi-blade cleaning system for a photoreceptor device, comprising:

a plurality of cleaning blades, each having a cleaning edge, for contact with a surface of a photoreceptor device, and an opposed securing edge;

a connecting means for connecting said plurality of cleaning blades at their securing edges so that they move in unison, wherein said connecting means forms said plurality of cleaning blades into an endless loop; and, a mechanism for advancing said plurality of cleaning blades, one by one, into contact with said photoreceptor device, wherein a cleaning blade which has its cleaning edge in contact with said photoreceptor device is oriented substantially normal to adjacent cleaning blades.

7. The cleaning system of claim 6 wherein said plurality of cleaning blades are cut from a block of material and said connecting means comprises an uncut portion of said block of material provided at a securing edge of each blade.

8. The cleaning system of claim 6 wherein said mechanism comprises a pair of substantially square rotatable shafts which selectively propel said endless loop and wherein said shafts are spaced from each other so as to stretch said endless loop between them.

9. The cleaning system of claim 8 wherein each of said blades is approximately as thick as one of said shafts.

10. A compact multi-blade cleaning system for a photoreceptor device, comprising:

a block of a thermoplastic material which has a plurality of parallel cuts extending partially through the block so as to form a plurality of parallel cleaning blades, each having a cleaning edge, for contact with a surface of a photoreceptor device, and an opposed securing edge;

a connecting means, formed by an uncut portion of said block, for connecting said plurality of cleaning blades at their securing edges so that they move in unison; and, a mechanism for advancing said plurality of cleaning blades, one by one, into contact with said photoreceptor device, wherein only a single cleaning edge contacts said photoreceptor device at any given time.

11. The cleaning system of claim 10 further comprising a seam at which ends of said block are secured to each other so that said block is formed into an endless loop with said plurality of cleaning blades being disposed outwardly thereof.

12. The cleaning system of claim 11 wherein said mechanism comprises a pair of square rotatable shafts which selectively propel said endless loop.

13. The cleaning system of claim 12 wherein said shafts are spaced from each other so as to stretch said endless loop between them.

14. The cleaning system of claim 13 wherein each of said blades is approximately as thick as one of said shafts.

15. The cleaning system of claim 14 wherein each of said shafts is approximately as long as said blades are wide.

16. A cleaning apparatus for cleaning a moving photoreceptor surface having particles thereon, comprising:

a plurality of cleaning blades, each having a first cleaning edge for contact with the photoreceptor surface;

an endless loop to which said plurality of cleaning blades are secured; and, an indexing means for indexing said plurality of cleaning blades, one at a time, into frictional contact with the photoreceptor surface, wherein a first cleaning blade, which is in contact with the photoreceptor surface, is oriented substantially normal to adjacent cleaning blades.

17. The apparatus of claim 16 wherein said indexing means comprises a pair of shafts which have said endless loop stretched between them, wherein said pair of shafts rotate to space said first cleaning blade away from the photoreceptor surface, and position a second cleaning blade into frictional contact with the photoreceptor surface.

18. The apparatus of claim 16 wherein each cleaning blade also comprises a second cleaning edge.

19. The apparatus of claim 17 wherein said pair of shafts move said endless loop such that said first cleaning blade is rotated by approximately 90° to bring it into contact with the photoreceptor surface and rotated by an additional 90° to remove it from contact with the photoreceptor surface.

20. The apparatus of claim 17 wherein said shafts each extend the entire width of said endless loop.

* * * * *